US005690089A

United States Patent [19]

Ward

[11] Patent Number: 5,690,089

[45] Date of Patent: Nov. 25, 1997

[54] MECHANICAL HAND GRENADE LAUNCHER

[75] Inventor: John Patrick Ward, Bel Air, Md.

[73] Assignee: The United States of America as represented by the Secretary of the Army, Washington, D.C.

[21] Appl. No.: 713,933

[22] Filed: Sep. 13, 1996

[51] Int. Cl.[6] ..... F41B 7/00

[52] U.S. Cl. ..... 124/26; 124/16; 124/37

[58] Field of Search ..... 124/16, 17, 20.1, 124/21, 26, 27, 29, 37

[56] References Cited

U.S. PATENT DOCUMENTS

| | | | |
|---|---|---|---|
| 768,028 | 8/1904 | Braun | 124/26 |
| 1,054,906 | 3/1913 | Gray | 124/26 X |
| 1,414,827 | 5/1922 | Peterson | 124/29 |
| 2,048,061 | 7/1936 | Donato | 124/16 |
| 2,600,883 | 6/1952 | King | 124/16 X |
| 2,751,711 | 6/1956 | Greenwood | 124/16 X |

FOREIGN PATENT DOCUMENTS

| | | | |
|---|---|---|---|
| 21981 | 2/1917 | Denmark | 124/26 |

*Primary Examiner*—John A. Ricci

*Attorney, Agent, or Firm*—William R. Medsger; Saul Elbaum

[57] ABSTRACT

A mechanical hand grenade launcher comprised of a launch tube and spring-driven plunger for propelling a hand grenade to a target area. At the aft end of the launcher is a charging handle that when pulled rearward compresses a spring within the launcher tube. When the spring has been sufficiently compressed, the spring is then locked in the cocked position by a safety pin attached to a first lanyard. A hand grenade is loaded through the fore end of the launcher and the grenade's pull pin is attached to a second lanyard. When rearward force is applied to the second lanyard, the grenade pull pin is dislodged from the grenade. To launch the grenade, rearward force is applied to the first lanyard dislodging the safety pin which releases the spring. The force of the expanding spring imparted to the hand grenade propels the hand grenade out of the fore end of the launch tube toward the target area.

2 Claims, 1 Drawing Sheet

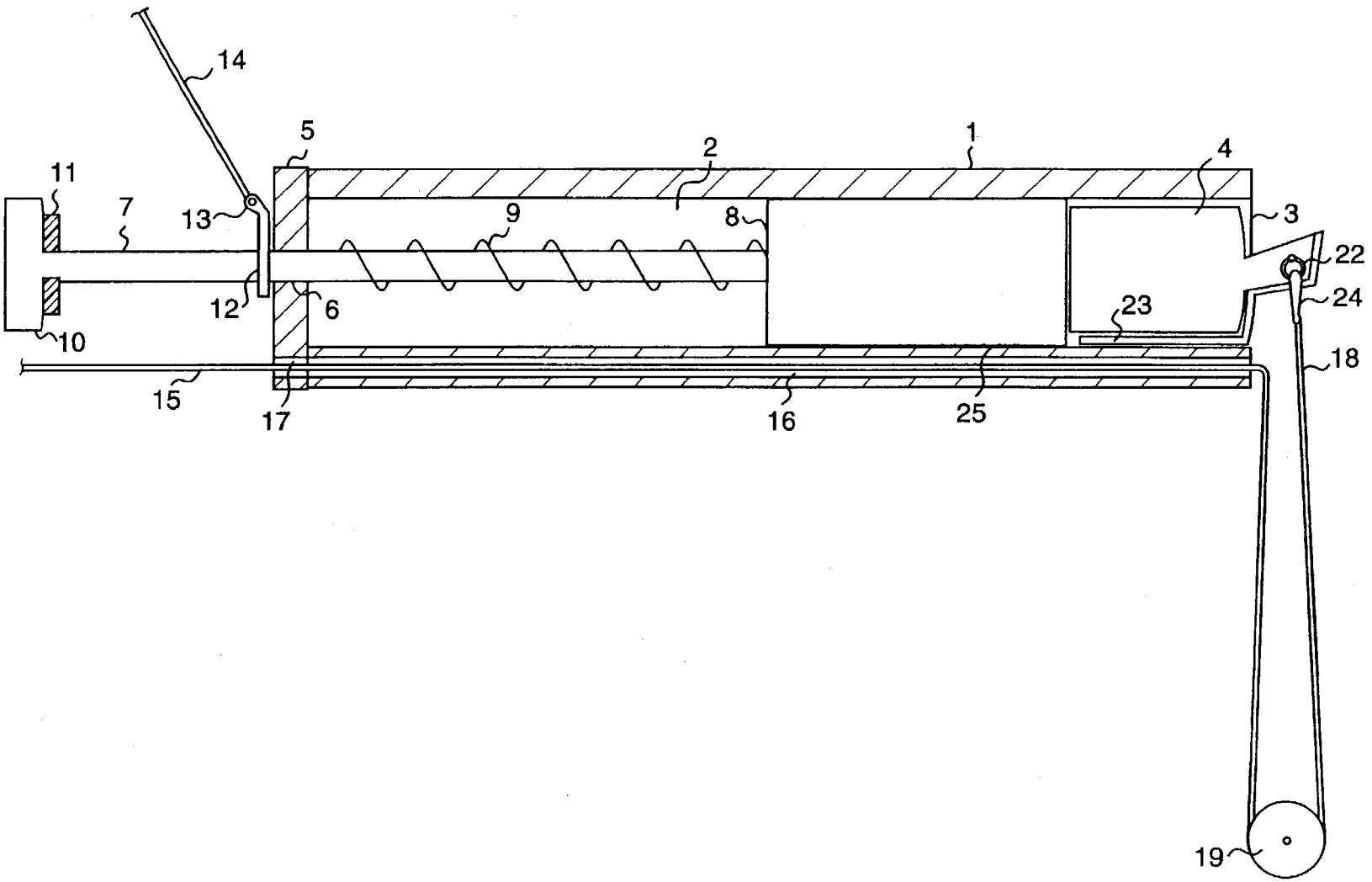
1
2
3
4
5
6
7
8
9
10
11
12
13
14
15
16
17
18
19
22
23
24
25

MECHANICAL HAND GRENADE LAUNCHER

BACKGROUND OF THE INVENTION

1. Field of the Invention

This invention relates to hand grenade launchers, and more particularly to a low cost, yet safe and effective, spring operated mechanical device for launching hand grenades.

2. Description of the Related Art

Hand grenades are effective offensive weapons because of their low cost, small size, ease of operation, and versatility in employment. The most common hand grenade consists of a metal enclosure containing an explosive charge. When the charge is ignited the enclosing material shatters propelling metal fragments at high velocity in the target area, often inflicting lethal injuries to any unprotected humans in the target area. Non-lethal hand grenades, often referred to as stun or distraction grenades, are used by military and law enforcement personnel. These grenades are not intended to inflict bodily harm, but instead produce a loud noise and brilliant flash of light which stuns and temporarily disorients personnel in the proximity of the explosion. These non-lethal grenades normally consist of an explosive charge encased in a harmless material such as cardboard or non-fragmenting metals.

Hand grenades are usually employed by manually throwing the grenade into the target area. However, this method of employment is not always ideal. For example, if the individual throwing the grenade is in the vicinity of the grenade explosion, the individual may be injured or suffer the same effects as the intended target. Thus, a remote mechanical launching device is a more suitable employment under some circumstances. For instance, personnel who are testing the effects of grenades are better protected if the mechanical grenade launcher launches the grenade toward the target while the testing personnel are located behind a protective barrier. In this scenario, there is less possibility that testing personnel will be injured or experience the effects of an exploding grenade. An object of this invention is to provide a light weight, low cost, safe, and easy to operate and maintain grenade launching device.

SUMMARY OF THE INVENTION

The present invention overcomes the disadvantages in the prior art through a simple, relatively low cost, minimal maintenance design. The present invention comprises a launch tube for mechanically launching hand grenades into a target area. An operator places a hand grenade into an open fore end of the launch tube. The operator actuates a lanyard means for dislodging a pull pin from the grenade. After the pull pin is dislodged, the operator then actuates a means for propelling the hand grenade out of the launch tube. The propelling means comprises the release of a compressed spring which imparts sufficient force against the hand grenade to propel the hand grenade out of the launch tube and into the desired target area.

Further objects, features, and advantages of the present invention will become apparent from the following description and drawings of the presently preferred embodiment of the invention.

BRIEF DESCRIPTION OF THE DRAWINGS

The Figure is a side elevational view of the preferred embodiment of the invention in the cocked position.

DESCRIPTION OF THE PREFERRED EMBODIMENT

The preferred embodiment of the present invention is configured for use with stun grenades. The preferred embodiment of the hand grenade launcher can best be seen by reference to the Figure, which depicts a side elevational view of the launcher tube partially cut away to show its details. The main component of the grenade launcher is a rigid launch tube (1) within which is disposed a longitudinal bore(2) extending the length of the launch tube (1). In the preferred embodiment, the launch tube (1) is cylindrical and fabricated from aluminum round stock and has a length of fourteen inches, an outside diameter of three inches and an inside diameter of two and one-eight inches. This particular size was chosen to accommodate the Army's XM84 grenade candidate. However, it is understood that launch tubes, which can be tailored with different dimensions for use with any specific hand grenade desired and fabricated from other rigid materials are also encompassed by the present invention.

The fore end (3) of the launch tube is open, through which the grenade (4) can be inserted and out of which the grenade is propelled when the launcher is fired. An end cap (5) is attached to the aft end of the launch tube (1). The end cap (5) contains a circular aperture (6) in the center of the face surface of the end cap (5) and is sized to allow a plunger rod (7) to protrude through the end cap aperture (6) and reciprocate within and along the center longitudinal axis of the launch tube (1). In the preferred embodiment, the plunger rod (7) is made from aluminum round stock and has a length of fourteen and one-eighths inches and an outside diameter of one inch.

Attached to the end of the plunger rod protruding into the launch tube is a plunger pusher (8). In the preferred embodiment, the plunger pusher (8) is a plastic cylinder device with a length of five and five-eights inches and an outside diameter of two and one-eights inches. Interposed between and abutting the end cap (5) and the plunger pusher (8) is a spring (9). In the preferred embodiment the spring (9) is a thirteen coil spring with an outside diameter of one and one-half inches. The spring (9) must be of sufficient tensile strength that when compressed and then rapidly released it will impart sufficient reactionary force to cause the plunger pusher (8) to propel the grenade (4) out of the open end (3) of the launch tube with sufficient velocity for the grenade (4) to travel the desired distance to the target area.

Attached to the other end of the plunger (7) is a charging handle (10). In the preferred embodiment, the charging handle (10) comprises an aluminum disk with a diameter of two and one-half inches and a depth of one inch. The purpose of the charging handle (10) is to allow the operator of the launcher to grip the charging handle (10) so as to be able to easily pull the plunger rod (7) rearward to the cocked position. Accordingly, any configuration of a charging handle in concert with the plunger rod (7) which serves this purpose is sufficient. Interposed between the end cap (5) and the charging handle (10) is a plunger pad (11). In the preferred embodiment the plunger pad (11) is constructed from a foam rubber washer with an outside diameter of two and one-quarter inches and a depth of one-half inch. The purpose of the plunger pad (11) is to prevent the charging handle from coming into direct contact with the end cap (5) when the plunger rod (7) is release from the cocked position and to dampen this convergence. In the center of the plunger pad (11) is a one inch aperture that permits the washer to encircle the plunger rod (7).

The portion of the plunger rod (7) protruding into the bore (2) of the launch tube when in the uncocked position contains an aperture (12) extending transversely to the longitudinal axis of the plunger rod (7). When the charging handle (10) is pulled rearwards to the cocked position the aperture (12) is located entirely outside the end cap (5). A steel safety pin (13) is inserted into the aperture (12) thereby holding the plunger rod (7) in the cocked position when the operator releases the charging handle (10). A first lanyard (14) is attached to the end of the safety pin (13) located outside the aperture (12). The first lanyard (14) must be of sufficient length to allow the operator of the grenade launcher to fire the grenade launcher from a sufficient distance from the launcher ensuring that the operator is not affected by the grenade explosion.

A second lanyard (15) extends through a bore (16) which extends parallel to the longitudinal axis of the entire length of the launch tube (1) and is disposed between the inside surface of the launch tube and the outside surface of the launch tube. The second lanyard (15) also extends through a bore (17) in the end cap which aligns and correspondences with the bore (16) of the launch tube. The end of the second lanyard (18) protruding from the open end (3) of the launch tube through which the grenade is inserted is threaded through a guide pulley wheel (19). The pulley wheel (19) possesses a inward grove around its circumference to accommodate the second lanyard. The pulley wheel (19) is freely rotably mounted on a suitable hardstand, tabletop, or whatever the user deems feasible at the time of use. The angle of pull should be no greater than ninety degrees and no less than forty-five degrees and slightly forward of the open end (3) of the launch tube and aligned in such a manner that when the grenade (4) is inserted into the launch tube (1) and the plunger rod (7) is in the cocked position the pulley wheel (19) is positioned immediately below the grenade pull pin (22). Thus, when the second lanyard (15) is pulled rearward by the operator, the grenade pull pin (22) becomes dislodged from the grenade (4). Attached to the end (18) of the second lanyard is a clip (24) that can be easily attached and removed from the grenade pull pin (22). The second lanyard (15) like the first lanyard (14) must be of sufficient length to allow the operator of the grenade launcher to dislodge the grenade pull pin (22) from sufficient distance from the launcher ensuring that the operator is not affected by any unexpected explosion of the grenade (4).

From the above description, the operation of the present invention is readily apparent. First the launch tube (1) is affixed to a hard mount (not shown)—any stationary device—with the launcher positioned in a firing azimuth and elevation to achieve the proper grenade launching distance. Referring to The Figure, to actuate the grenade launcher the operator pulls back on the charging handle (10) causing the plunger pusher (8) to compress the spring (9) against the end cap (5). The charging handle (10) is pulled back until the aperture (12) in the plunger rod is visible outside the launch tube. Then the operator inserts the safety pin (13) into the aperture (12) and releases the charging handle (10). The portion of the safety pin (13) extending from the aperture abuts against the end cap (5) preventing the plunger rod (7) from escaping back into the bore (2) of the launch tube. The launcher is now in the cocked position.

The grenade (4) is inserted into the open end (3) of the launch tube with the end of the grenade opposite the grenade pull pin (22) inserted into the bore (2) of the launch tube first. The grenade (4) slides down the bore (2) until the grenade (4) rests against the plunger pusher (8). The launcher is constructed so that the grenade (4) slides down the bore (2) only such a distance that the grenade pull pin (22) slightly protrudes from the open end (3) of the launch tube. The second lanyard (23) is threaded around pulley wheel (19) and sits in the grove around the pulley wheel. The clip (24) at the end of the second lanyard(23) is fastened to the grenade pull pin (22). The operator then retreats to a safe location behind the launcher. The first and second lanyards extend from the launcher to the safe location.

To fire the launcher the operator pulls the end of the second lanyard (15) away from the launcher. This movement of the second lanyard (15) through the bore (16) longitudinally extending through the length the launch tube and around the pulley wheel (19) causes the second lanyard (15) to become taunt and results in the grenade rotating in the bore (2) of the launch tube until the grenade pull pin (22) aligns transversely to the pulley wheel (19). Further rearward movement of the second lanyard (15) causes the grenade pull pin (22) to dislodge from the grenade (4). Because the spoon handle (23) of the grenade is in the bore (2) of the launch tube and is constrained by the inside wall of the launch tube, the grenade is in no danger of exploding before launching occurs. Once the grenade pull pin (22) is dislodged, the operator pulls the first lanyard (14) away from the launcher until the first lanyard becomes taunt. Further rearward movement of the first lanyard (14) causes the safety pull pin (13) to be completely dislodged from the aperture (12) in the plunger rod (7). Once the safety pull pin (12) is dislodged, the compressed spring (9) in the launch tube (1) exerts a force against the end cap (5) and an opposite force against the plunger pusher (8) causing the plunger pusher (8) to rapidly move toward the open end (3) of the launch tube as the spring (9) expands. The forward force of the moving plunger pusher (8) is imparted to the grenade (4) causing the grenade to exit the launch tube (1) at sufficient velocity to cause the grenade to propel to the target area.

As can be readily seen, the described invention provides a low maintenance, low cost, light weight, safe, and effective hand grenade launcher. The dimensions and materials described for the preferred embodiment are merely for illustration, and it is readily apparent that other materials of differing dimensions may also be employed in the practice of the present invention. Other modifications will become apparent to those skilled in the art from the foregoing description and appended drawings. Accordingly, the invention herein is not to be construed as being limited, except insofar as expressly provided or as the claims may require.

What is claimed:

1. A hand grenade launcher, comprising:

a launch tube with an open end into which a hand grenade may be inserted;

an end cap attached to said launch tube at the end opposite to which the hand grenade may be inserted;

a plunger rod protruding through an aperture in said end cap and reciprocating in said launch tube;

a plunger pusher attached to said plunger rod within said launch tube;

a spring disposed between said end cap and said plunger pusher within said launch tube;

a charging handle attached to said plunger rod outside said launch tube;

a safety pin extending through an aperture in said plunger rod outside said launch tube; and a first lanyard attached to said safety pin.

2. A hand grenade launcher as recited in claim 1, further comprising a second lanyard with means for attaching the second lanyard to the hand grenade which may be inserted into said launch tube.

* * * * *